US011512544B2

(12) United States Patent
Wermann et al.

(10) Patent No.: US 11,512,544 B2
(45) **Date of Patent: *Nov. 29, 2022**

(54) FLUID HANDLING DEVICE

(71) Applicant: Saturn Machine Works Ltd., Edmonton (CA)

(72) Inventors: Bernard Wermann, Edmonton (CA); Patrick Folick, Edmonton (CA); Michael Lang, New Sarepta (CA)

(73) Assignee: Saturn Machine Works Ltd., Edmonton (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/144,781

(22) Filed: Jan. 8, 2021

(65) Prior Publication Data

US 2021/0131207 A1 May 6, 2021

Related U.S. Application Data

(63) Continuation of application No. 15/808,843, filed on Nov. 9, 2017, now Pat. No. 10,900,304.

(30) Foreign Application Priority Data

Oct. 13, 2017 (CA) ..... CA 2982295

(51) Int. Cl.
*E21B 21/10* (2006.01)
*E21B 34/06* (2006.01)

(52) U.S. Cl.
CPC ..... *E21B 21/103* (2013.01); *E21B 34/06* (2013.01); *E21B 2200/06* (2020.05)

(58) Field of Classification Search
CPC ..... E21B 21/103; E21B 2200/06; E21B 34/06
See application file for complete search history.

(56) References Cited

U.S. PATENT DOCUMENTS 4,263,936 A 4/1981 Brown
2008/0314588 A1* 12/2008 Langlais ..... E21B 41/0078 166/278
2013/0306318 A1* 11/2013 Frosell ..... E21B 41/0078 166/305.1
2015/0096809 A1* 4/2015 Kerstetter ..... E21B 4/003 175/100

OTHER PUBLICATIONS

Drilling Motor Handbook, 2015 Edition Rev. A, Toro Downhole Tools, Tomball, Texas, US, 38 pages.
Information Sheet for Adaptor, Bearing Mandrel 8.000 in ML, Part No. 01396792, Weatherford, Mar. 2013, 4 pages.

* cited by examiner

*Primary Examiner* — Caroline N Butcher
(74) *Attorney, Agent, or Firm* — Lowe Graham Jones PLLC

(57) ABSTRACT

A flow diverter for connecting a central bore to an outer conduit. The flow diverter defines a portion of the central bore and angled flow passages connecting the portion of the central bore to the outer conduit. Rounded edges between the central bore and angled flow passages reduce cavitation and/or turbulence. The rounded edges and an adjacent portion of the central bore may be defined by an insert.

5 Claims, 3 Drawing Sheets

FLUID HANDLING DEVICE

PRIORITY CLAIM

This application is a continuation of U.S. patent application Ser. No. 15/808,843, filed Nov. 9, 2017, which claims the benefit of priority from Canada Patent Application No. 2,982,295, filed Oct. 13, 2017, the contents of which are incorporated herein by reference.

FIELD OF THE INVENTION

Fluid handling.

BACKGROUND OF THE INVENTION

In the context of this document, the term "flow diverter" refers to an element shaped to define one or more flow channels connecting a first conduit with a second conduit. One example context in which a flow diverter is used is in a drilling motor for powering a drill bit. Drilling mud flows through a bore to a power section of a drilling motor to power the drilling motor. The mud then flows through an annular conduit around a coupling between the power section and a drive shaft. The annular conduit continues around an upper end of the drive shaft. The drive shaft has a central bore through which mud flows to lubricate the drill bit. The mud flows from the annular conduit to the central bore via a flow diverter having angled ports connecting the annular conduit to the bore. As the flow diverter is connected to the drive shaft it is rotating with the drive shaft at typically between 100-250 rpm. Conventional flow diverter designs can have various angles of the ports relative to the bore, for example at 90 degrees, 45 degrees, or 30 degrees. The mud flow can be for example 115-315 gpm and there are typically 4 ports of diameter about 1¼". This flow of mud through the angled ports into the bore can result in washout in the walls of the diverter at or near the intersection of the bore and the ports. The diverter is typically scrapped when the walls are deemed compromised due to a certain amount of washout being present.

The example figures given above lead to an average flow speed of mud of about 7.5 to 20.5 ft/s through the 4 ports. According to Schlumberger Oilfield Glossary, "For erosion to occur usually requires a high fluid velocity, on the order of hundreds of feet per second, and some solids content, especially sand." The bore of a flow diverter may have a smaller total area than the ports, depending on the pressure and flow required by the mod motor or turbine. This can lead to a higher average flow speed in the bore than in the ports, but the speeds will typically remain below the hundreds of feet per second stated by Schlumberger to be needed for erosion. A person skilled in the art might therefore conclude that flow diverters should not wash out. Nonetheless, washout of the bore is observed to occur near the ports.

Due to the positioning of the washout near the ports, a conventional cylindrical wear sleeve may not adequately protect a flow diverter from washout, and in any case might have to be replaced frequently due to the above mentioned washout occurring to the wear sleeve, with corresponding inconvenience. Thus, there is a need for improved lifespan of flow diverters.

SUMMARY OF THE INVENTION

There is provided a fluid handling device having flow channel walls defining a flow channel, and inlet walls defining an inlet to the flow channel. The fluid handling mechanism is configured to direct an inlet fluid flow at an inlet flow rate into the flow channel via the inlet and to direct a downstream flow at a downstream flow rate in a downstream direction within the flow channel downstream of the inlet. Transitional wall portions form a transition between the inlet walls and the flow channel walls at least in the downstream direction from the inlet. The transitional wall portions are configured to be sufficiently smooth and to have sufficient radius of curvature to prevent cavitation within the flow channel at the transitional wall portions and immediately downstream of the transitional wall portions when fluid flows at the inlet flow rate into the flow channel via the inlet and at the downstream flow rate in the downstream direction within the flow channel downstream of the inlet.

In various embodiments, there may be included any one or more of the following features: the fluid handling device may comprise a housing and an insert, the insert comprising the transitional wall portions, and the housing comprising the inlet walls or the flow channel walls. The insert may comprise the transitional wall portions and at least a portion of the flow channel walls downstream of the inlet, and the housing may comprise the inlet walls.

There is also provided a flow diverter having a body defining a central bore. The central bore has an opening at a first end of the body, and the body further defines flow channels angled relative to the central bore and connecting the central bore to an exterior surface of the body. The body also defines fillets connecting the flow channels to the central bore.

In various embodiments, there may be included any one or more of the following features: the body may comprise a housing defining a cavity extending from the opening and an insert inserted within the cavity, the insert defining the fillets and at least a portion of the central bore adjacent to the fillets. The housing may be formed of a first material and the insert may be formed of a second material more abrasion resistant than the first material. There may be a first connector at the first end configured to connect the flow diverter to a drive shaft of a drilling motor and a second connector at a second end opposite to the first end configured to connect the flow diverter to a coupling for connecting to a power section of the drilling motor.

There is also provided an insert for a flow diverter, the insert defining a central bore and having curved portions adjacent to the central bore configured to, when the insert is inserted in the flow diverter, form fillets connecting the central bore to flow channels defined by the flow diverter, the flow channels being angled relative to the central bore and connecting the central bore to an exterior surface of the flow diverter when the insert is inserted in the flow diverter.

These and other aspects of the device are set out in the claims.

BRIEF DESCRIPTION OF THE DRAWINGS

Embodiments will now be described with reference to the figures, in which like reference characters denote like elements, by way of example, and in which.

DETAILED DESCRIPTION OF THE PREFERRED EMBODIMENT

Figure 1:
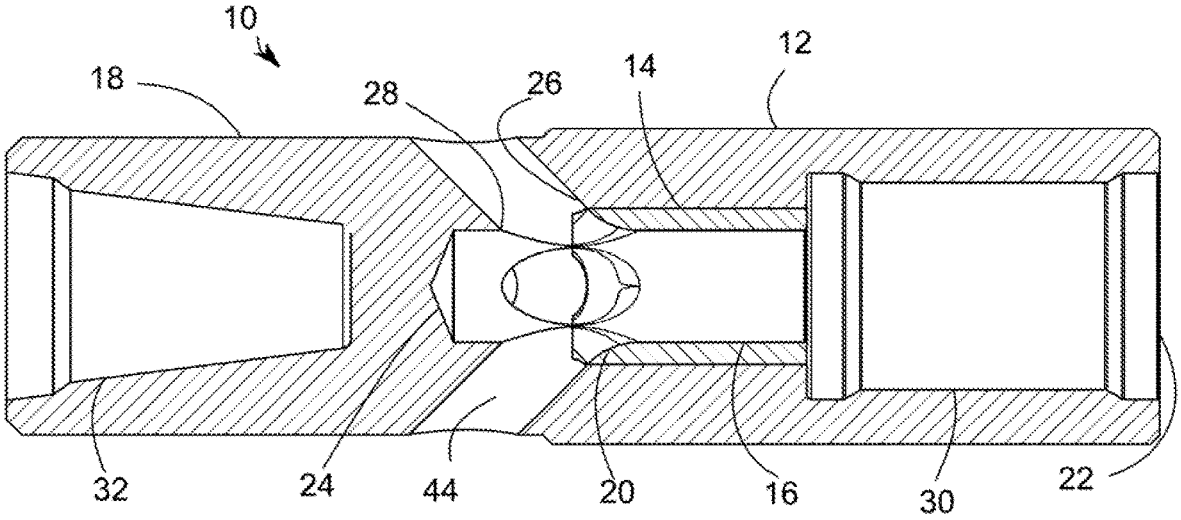
FIG. 1 is a side cutaway of a flow diverter.

The inventors believe that washout occurs in conventional flow diverters and other fluid handling mechanisms due to the turbulence and (hydrodynamic) cavitation caused as the fluid traverses an angle between the straight flow channel and straight bore. As fluid traverses a sharp angle where a wall diverges away from the incoming flow direction, it has momentum carrying it in its original direction resulting in a sharp pressure drop adjacent to the wall downstream of the angle. This pressure drop may be enhanced where the downstream wall is a boundary of a constricted channel where Bernoulli's principle applies, but the localized pressure immediately downstream of the angle at the wall may be well below the pressure expected from Bernoulli's principle given the average flow rate. The localized pressure drop can lead to cavitation at the wall shortly downstream of the angle. Due at least to turbulence, the cavitation is not steady but may repeatedly collapse leading to damage to the walls. Cavitation bubbles may also continue downstream and collapse leading to damage shortly downstream of the angle. Washout will occur in other fluid handling devices for the same reasons and thus the solution proposed below may also be applied to other applications where a wall diverges away from an incoming flow direction.

In order to reduce this disturbed fluid flow, there are therefore provided curved transition surfaces between the angled flow channels and the bore. The curved surfaces alter the flow at the exit point of the angled flow port or ports into the bore, creating a smoothed transition into the bore. The fluid traverses the angle gradually reducing the abrupt pressure drop at the walls present in a sharp transition. They also lower the fluid velocity creating a more gradual change in velocity and pressure at and beyond the transition. For the purpose of this document, these curved surfaces shaped to reduce cavitation and/or turbulence will be referred to as fillets. However, fabricating the fillets may pose challenges if the flow diverter is formed as one piece. For example, forming the fillets by machining would be difficult if not impossible in a one piece configuration. Thus, in an embodiment an insert is provided defining the fillets. The insert may also act as a wear sleeve which defines the bore at the intersection of the bore and flow channels, and immediately downstream of the intersection. An insert may also be inserted in an inlet flow channel and may define walls of the inlet flow channel and the fillet corresponding to the inlet flow channel. The insert may be made of a different material than the rest of the flow diverter. Thus the insert can be made out of various materials to provide the best possible wear resistance and part life for the conditions it is being used in. For example the insert may be made of a more abrasion resistant material to increase washout resistance. The insert may also have various surface treatments including coatings and treatments that alter the surface texture to modify boundary layer conditions and/or the fluid interaction with the surface of the sleeve.

The fillets may have an elliptical profile as seen in a cross section perpendicular to the flow. The fillets may have a radius that is variable based on the entry angle of the port. Parameters of the profile may be chosen to mitigate cavitation.

An exemplary embodiment is described in relation to FIGS. 1-4.

FIG. 1 shows a side cross section of the exemplary embodiment of the flow diverter. As shown in FIG. 1, the flow diverter 10 comprises a body formed of a housing 12 and an insert 14. The body defines a central bore 16, a portion of the central bore being defined by insert 14, and the housing defines angled flow channels 44 connecting the central bore to an outer surface 18 of the housing. The insert defines curved surfaces 20 which form fillets in relation to the central bore and angled flow channels. The bore has an open end 22 and a closed end 24. The fillets connect to portions 26 of the angled flow channels positioned in a direction of intended flow from the angled flow channels into the bore, or if flow in the opposite direction occurred, positioned in a direction from which flow occurs from the bore into the angled flow channels. The portions 26 will thus be outer portions of the angled flow channels where the angled flow channels are at less than 90 degrees with respect to the bore, or portions closer to the open end of the bore where there is an open end and a closed end. It is believed that fillets are not needed at opposite edges 28 which are away from the intended direction of flow from the angled flow channels into the bore. At the open end 22 there is a coupling 30 for coupling the flow diverter to a drive shaft of a drilling motor. At the closed end 24 there is a coupling 32 for coupling the flow diverter to a coupling for connecting to a power section of the drilling motor.

Figure 2A:
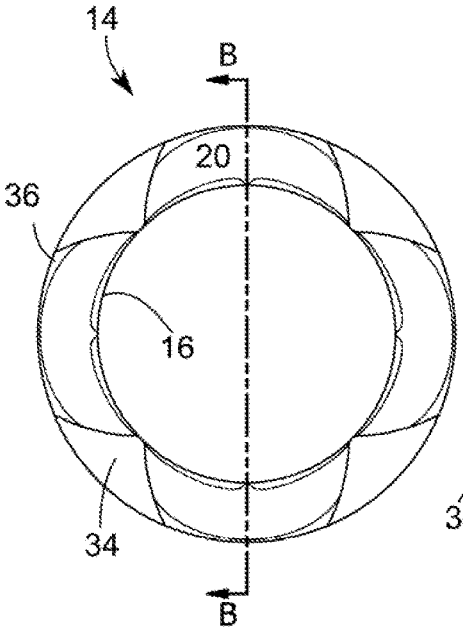
FIG. 2A is an end view of an insert in the flow diverter of FIG. 1.
Figure 2B:
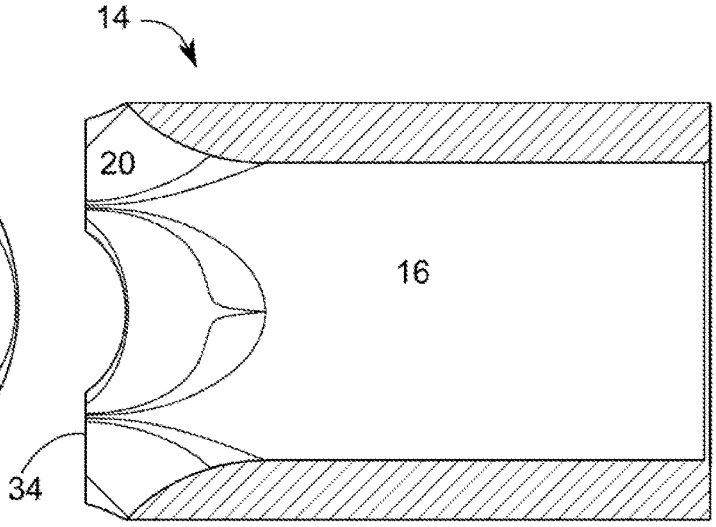
FIG. 2B is a side cutaway of the insert of FIG. 2A as cut on section lines B-B as shown in FIG. 2A, and is also a closeup of the insert as shown in FIG. 1.

FIG. 2*a* and FIG. 2B show the insert 14 more closely. FIG. 2A is an end view and FIG. 2B is a side cutaway view of the insert 14 showing fillets 20 and end portions 34 which contact the housing between the angled flow channels. In the embodiment shown, the fillets curve smoothly from the central bore 16 to portions 36 which are aligned with cylindrical walls of the angled flow channels when the insert is inserted into the housing.

Figure 3:
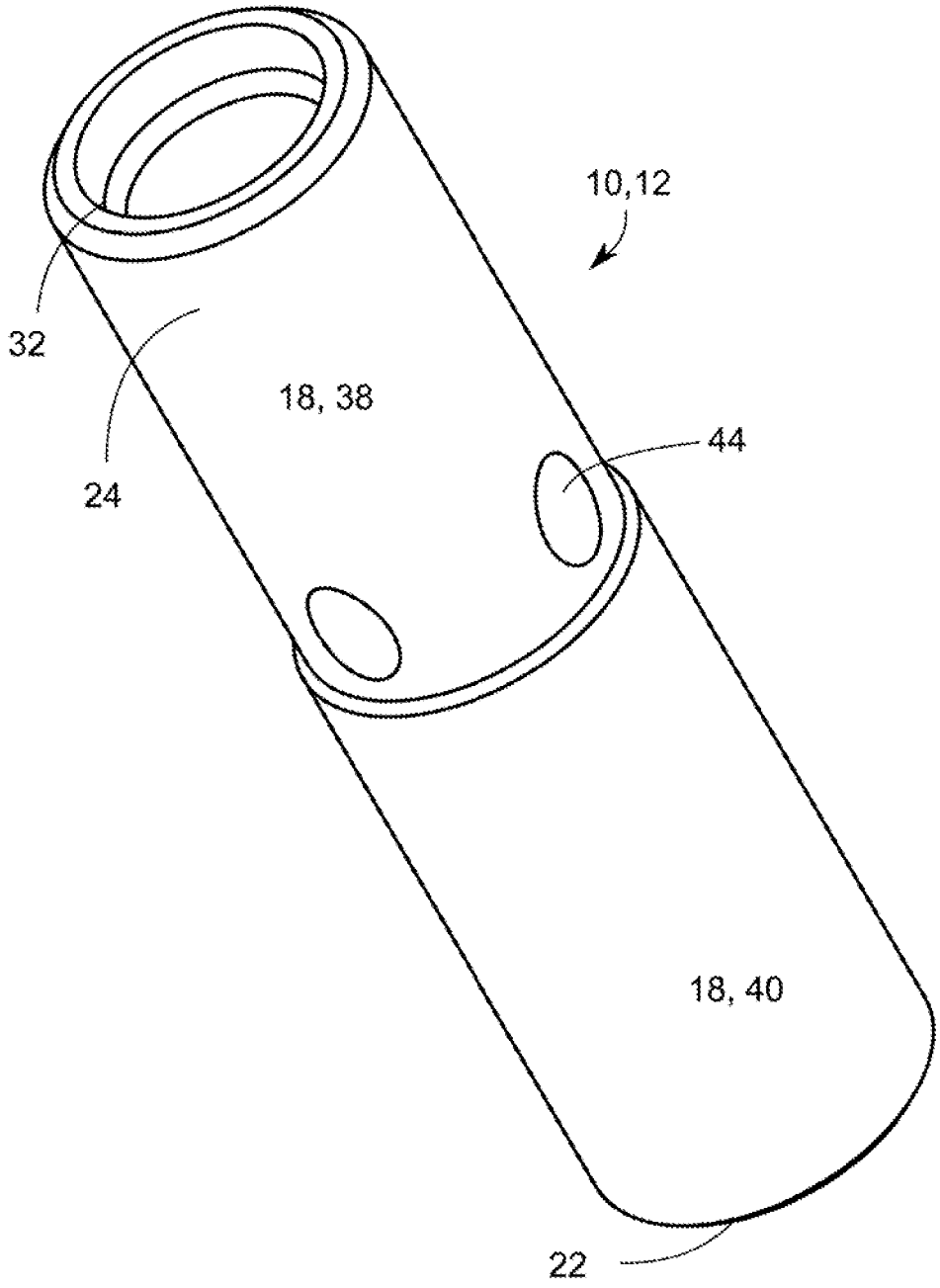
FIG. 3 is an isometric view of the flow diverter of FIG. 1.

FIG. 3 shows an isometric view of the flow diverter showing coupling 32 at closed end 24. The housing has a narrower portion 38 at closed end 24 and a wider portion 40 at open end 22. The outer surface of the housing at narrower portion 38 defines an inner boundary of an annular channel to which the angled flow channels 44 connect when the flow diverter is installed in a drilling motor.

Figure 4:
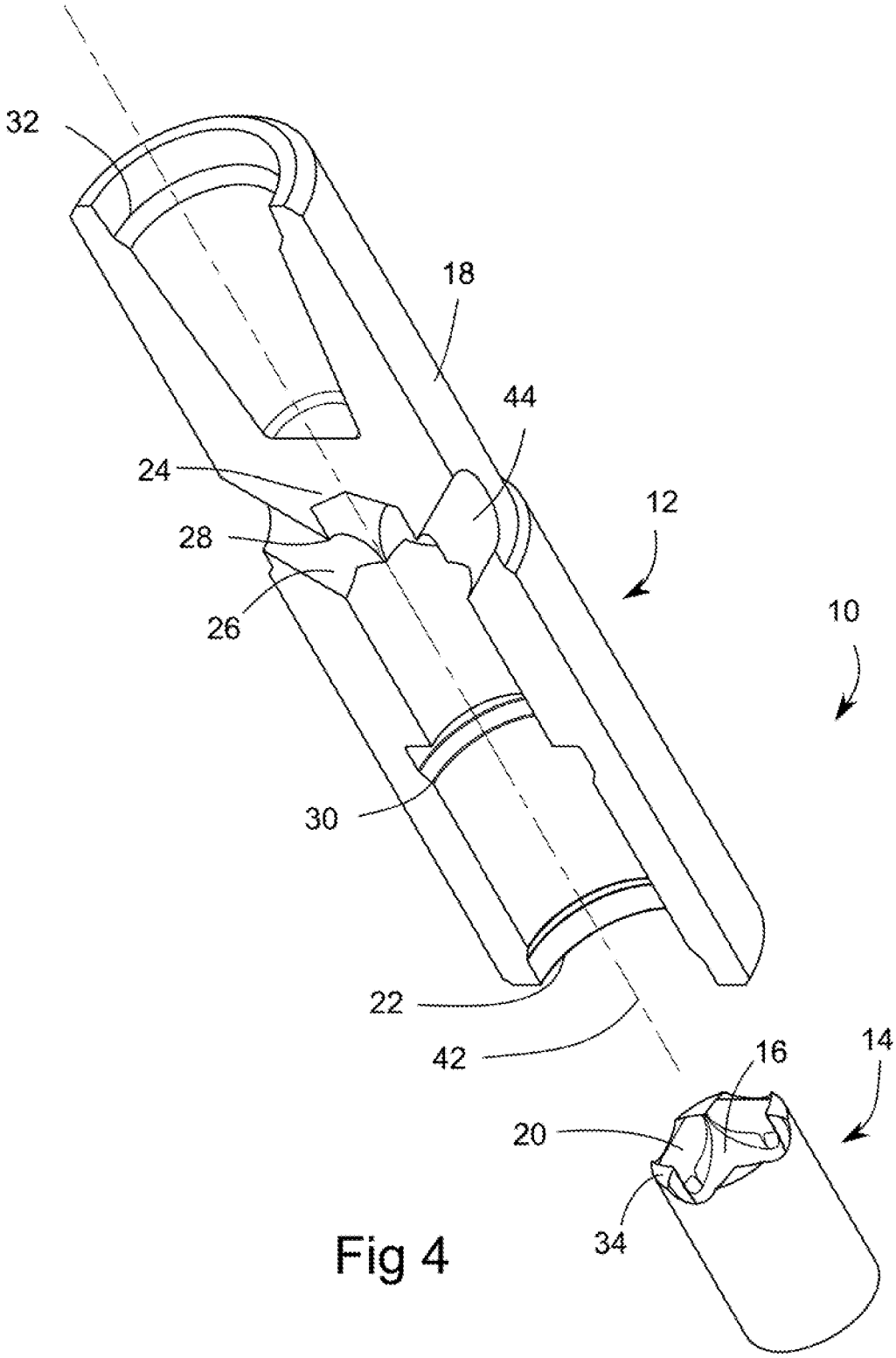
FIG. 4 is a cutaway exploded isometric view of the flow diverter of FIG. 1, with a dashed line showing a central axis along which the insert is displaced out of the flow diverter.

FIG. 4 shows a cutaway exploded isometric view of the flow diverter of FIG. 1. The insert 14 is shown displaced out of the flow diverter in the direction of the open end 22. Dashed line 42 shows a central axis along which the insert is displaced in this example.

Immaterial modifications may be made to the embodiments described here without departing from what is covered by the claims.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A flow diverter comprising:

a body having bore walls defining a central bore, the central bore having an opening at a first end of the body, the body further including flow channel walls defining flow channels angled relative to the central bore and connecting the central bore to an exterior surface of the body, the body defining fillets connecting the flow channel walls to the bore walls.

2. The flow diverter of claim 1 in which the body comprises a housing defining a cavity extending from the opening and an insert inserted within the cavity, the insert defining the fillets and at least a portion of the bore walls adjacent to the fillets.

3. The flow diverter of claim 2 in which the housing is formed of a first material and the insert is formed of a second material more abrasion resistant than the first material.

4. The flow diverter of claim 1 further comprising a first connector at the first end configured to connect the flow diverter to a drive shaft of a drilling motor and a second connector at a second end opposite to the first end configured to connect the flow diverter to a coupling for connecting to a power section of the drilling motor.

5. An insert for a flow diverter, the insert having bore walls defining a central bore and having curved portions adjacent to the bore walls configured to, when the insert is inserted in the flow diverter, form fillets connecting the bore walls to flow channel walls of the flow diverter defining flow channels, the flow channels being angled relative to the central bore and connecting the central bore to an exterior surface of the flow diverter when the insert is inserted in the flow diverter.

* * * * *